US010033119B2

(12) United States Patent
Koellmann

(10) Patent No.: US 10,033,119 B2
(45) Date of Patent: Jul. 24, 2018

(54) CONNECTING TERMINAL AND METHOD FOR FITTING A CONNECTING TERMINAL

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 15/525,857

(22) PCT Filed: Dec. 17, 2015

(86) PCT No.: PCT/EP2015/080310
§ 371 (c)(1),
(2) Date: May 10, 2017

(87) PCT Pub. No.: WO2016/102322
PCT Pub. Date: Jun. 30, 2016

(65) Prior Publication Data

US 2017/0331200 A1 Nov. 16, 2017

(30) Foreign Application Priority Data

Dec. 22, 2014 (DE) ..... 10 2014 119 421

(51) Int. Cl.
*H01R 12/88* (2011.01)
*H01R 4/28* (2006.01)
(Continued)

(52) U.S. Cl.
CPC ..... *H01R 4/28* (2013.01); *H01R 4/4836* (2013.01); *H01R 4/52* (2013.01); *H01R 4/4845* (2013.01); *H01R 12/88* (2013.01)

(58) Field of Classification Search
CPC ..... H01R 4/4836; H01R 4/48; H01R 4/4818; H01R 2103/00; H01R 2107/00;
(Continued)

(56) References Cited

U.S. PATENT DOCUMENTS 2,326,327 A 8/1943 Brewer
7,618,279 B1 11/2009 Osborn, Jr. et al.
(Continued)

FOREIGN PATENT DOCUMENTS

DE 10 2013 101 830 A1 7/2014
DE 10 2013 101 409 A1 8/2014

*Primary Examiner* — Truc Nguyen
(74) *Attorney, Agent, or Firm* — Muncy, Geissler, Olds & Lowe, P.C.

(57) ABSTRACT

A connecting terminal for connecting at least two electrical conductors to one another, wherein the connecting terminal has at least two separate housing parts which are mechanically connected to one another and each have a conductor insertion opening for at least one electrical conductor which is to be connected on opposite housing sides, wherein there is a first spring-force clamping connection for making electrical contact with a first electrical conductor in a first housing part of the at least two separate housing parts, and there is a second spring-force clamping connection for making electrical contact with the second electrical conductor in the second housing part of the at least two separate housing parts. A method for fitting a connecting terminal for connecting at least two electrical conductors is also provided.

17 Claims, 5 Drawing Sheets

(51) Int. Cl.
*H01R 4/52* (2006.01)
*H01R 4/48* (2006.01)

(58) Field of Classification Search
CPC ..... H01R 24/40; H01R 43/16; H01R 4/4845; H01R 12/515; H01R 13/5804; H01R 13/639; H01R 2105/00; H01R 9/05; H01R 12/7005
See application file for complete search history.

(56) References Cited

U.S. PATENT DOCUMENTS 7,628,640 B2 12/2009 Radle
7,963,790 B1 * 6/2011 Winter, Jr. ..... H01R 13/055 439/264
9,466,895 B2 10/2016 Koellmann et al.
2009/0017691 A1 * 1/2009 Breen, IV ..... H01R 4/4818 439/658
2009/0124139 A1 * 5/2009 Gerberding ..... H01R 4/4836 439/861
2009/0156041 A1 * 6/2009 Radle ..... H01R 4/4845 439/291
2010/0068925 A1 3/2010 Daily
2010/0081316 A1 * 4/2010 Eppe ..... H01H 1/5844 439/441
2011/0053406 A1 3/2011 Lin
2011/0223795 A1 * 9/2011 Schafmeister ..... H01R 4/4836 439/370
2013/0157520 A1 * 6/2013 Koellmann ..... H01R 4/4836 439/834
2015/0162671 A1 * 6/2015 Hoppmann ..... H01R 4/4836 439/370
2015/0303594 A1 * 10/2015 Stadler ..... H01R 4/4836 439/729
2015/0357726 A1 * 12/2015 Hoppmann ..... H01R 4/4818 439/816
2016/0006176 A1 * 1/2016 Kollmann ..... H01R 4/4836 439/346

* cited by examiner

A–A

CONNECTING TERMINAL AND METHOD FOR FITTING A CONNECTING TERMINAL

This nonprovisional application is a continuation of International Application No. PCT/EP2015/080310, which was filed on Dec. 17, 2015, and which claims priority to German Patent Application No. 10 2014 119 421.7, which was filed in Germany on Dec. 22, 2014, and which are both herein incorporated by reference.

BACKGROUND OF THE INVENTION

Field of the Invention

The invention relates to a connecting terminal for connecting at least two electrical conductors to one another, wherein the connecting terminal has at least two separate housing parts, which are connected mechanically to one another and, on opposite housing sides, each have a conductor insertion opening for at least one electrical conductor which is to be connected, wherein there is a first spring-force clamping connection for making electrical contact with a first electrical conductor in a first housing part of the at least two separate housing parts, and there is a second spring-force clamping connection for making electrical contact with the second electrical conductor in the second housing part of the at least two separate housing parts. The invention furthermore relates to a method for assembling a connecting terminal for connecting at least two electrical conductors.

Description of the Background Art

Connecting terminals of this kind with conductor insertion openings arranged on opposite housing sides, which are also referred to as dual terminals, are known from DE 10 2013 101 830 A1, for example. U.S. Pat. No. 7,628,640 B2 discloses a connecting terminal having two separate housing parts, each of which forms one half of the connecting terminal. To form the overall connecting terminal, the two parts can be fitted together. They are connected electrically to one another by an electrical plug-in connection and are simultaneously also held against one another mechanically by the plug-in connection. Accordingly, the electrical plug-in connection is also subject to mechanical stresses during the operation of the connecting terminal, which can lead to increased wear on the plug-in connection and accordingly to an impairment of the electrical contact.

SUMMARY OF THE INVENTION

It is an object of the invention to specify a connecting terminal for connecting at least two electrical conductors which is formed in a modular fashion using at least two separate housing parts but does not have the disadvantages of the abovementioned connecting terminal. The intention is furthermore to specify an advantageous method for assembling a connecting terminal of this kind.

The object is achieved by a connecting terminal for connecting at least two electrical conductors to one another, wherein the connecting terminal has at least two separate housing parts, which are connected mechanically to one another and, on opposite housing sides, each have a conductor insertion opening for at least one electrical conductor which is to be connected, wherein there is a first spring-force clamping connection for making electrical contact with a first electrical conductor in a first housing part of the at least two separate housing parts, and there is a second spring-force clamping connection for making electrical contact with the second electrical conductor in the second housing part of the at least two separate housing parts, wherein the first housing part is coupled mechanically to the second housing part via coupling means formed on the respective housing part.

This gives a connecting terminal of modular construction which enables electrical conductors to be brought into electrical contact and connected to one another safely and in a manner which is reliable over the long term while simultaneously offering high mechanical robustness. The coupling means formed on the respective housing part, which, in particular, can be formed integrally with the respective housing part, absorb forces acting externally on the connecting terminal and keep them away from the electrical contacts. It is thus possible to use the production and logistic advantages of a connecting terminal of modular construction without any associated technical disadvantages.

In this arrangement, the first housing part can be coupled to the second housing part directly or indirectly via another component. Thus, the coupling means, formed on the respective housing part, of the first and of the second housing part can be in engagement with one another directly or indirectly via an additional component.

Another advantage of the invention is that the tried and tested construction of known individual terminals of very compact design, such as that illustrated in DE 10 2013 101 409 A1 for example, can be transferred to connecting terminals, in particular dual terminals. Thus, in particular, an embodiment with a lever-actuated opening mechanism accommodated compactly in the housing can now be implemented as a connecting terminal.

The connecting terminal according to the invention can be designed as an individual connecting terminal, in which only the two conductor insertion openings arranged on opposite housing sides are provided, or as a multiple connecting terminal, e.g. in such a way that a plurality of individual connecting terminals are arranged adjacent to one another in a row. In this case, it is possible, in particular, for there to be an electrical connection, e.g. via a common conductor bar, between adjacent connecting terminals in the row of connecting terminals.

It should be noted that the connecting terminal is not an electrical plug-in connection. Electrical plug-in connections are of fundamentally different construction from connecting terminals since the electrical plug-in connections are designed for multiple connection and release of the plug connector parts to and from one another, while a connecting terminal, in particular the connecting terminal according to the invention, although being formed by a plurality of parts in modular fashion, is not designed to enable the housing parts to be taken apart or released from one another after said housing parts have been fitted together. Thus, the coupling means for the mechanical coupling of the housing parts can be designed as a latching or snap-in connection, for example, in particular as a connection which cannot be opened again without damage or can be opened again only with a special tool.

To provide the electrical connection between the spring-force clamping connections of the connecting terminal, a respective conductor bar element can be arranged in the first and in the second housing part, for example. The conductor bar elements can then be connected to one another by means of a plug-in or screwed joint.

According to an advantageous development of the invention, the connecting terminal has a conductor bar which is continuous from the first spring-force clamping connection to the second spring-force clamping connection. In particular, the conductor bar can be produced integrally from a metallic material. This has the advantage that the electrical connection between the conductors to be connected to one another by the connecting terminal is optimized and a high current carrying capacity can be achieved. Moreover, the continuous conductor bar assists with the mechanical stability of the connecting terminal.

According to an advantageous development of the invention, the first housing part is coupled mechanically to the second housing part via a connecting part arranged in the region of transition from the first to the second housing part and formed as a separate component. In this way an additional component is introduced, which is used for mechanically coupling the housing parts of the connecting terminal and can additionally exert a supporting effect, which thus increases the stability of the connecting terminal. In this case, the connecting part can be designed in the manner of a central piece or of a support component, for example. As will be explained below, the connecting part can be designed as a multifunctional component with additional functions.

The connecting part can be produced from an insulating or a non-insulating material, e.g. from plastic or from metal. In particular, the connecting part can be produced from the same material as the first and the second housing part. The first and the second housing part are produced from an insulating material, in particular from plastic.

According to an advantageous development of the invention, the first housing part and/or the second housing component are connected mechanically to the connecting part by means of a latching or snap-in connection. This allows simple and rapid assembly of the parts of the connecting terminal, generally without a tool, and a connecting terminal construction which is ergonomic and optimized in terms of overall size. Thus, the coupling means can advantageously be designed as latching hooks and latching recesses, which are designed as mating parts for said hooks.

According to an advantageous development of the invention, the connecting part has a partition wall, arranged substantially perpendicular to the conductor insertion direction of the first and/or the second housing part, between the first spring-force clamping connection and the second spring-force clamping connection, said wall serving as a conductor stop. The conductor stop or partition wall has the effect that a conductor inserted into a conductor insertion opening cannot be inserted further than a position envisaged for it. By virtue of the conductor stop, this maximum insertion position can be detected easily by touch. The partition wall can be arranged in the region of transition from the first to the second housing component, for example.

According to an advantageous development of the invention, the connecting part has at least one conductor insertion section, which is arranged in the conductor insertion direction or obliquely to the conductor insertion direction of the first and/or of the second housing part. The conductor insertion section is used to guide a conductor inserted into a conductor insertion opening to a defined position within the connecting terminal. During this process, the conductor can slide along the conductor insertion section.

By virtue of the abovementioned further features of the connecting part, said part can be embodied as a multifunctional component which, in addition to the actual function of connection between the housing parts of the connecting terminal, can perform one or more of the additional functions mentioned.

According to an advantageous development of the invention, the first housing part is designed to overlap the second housing part, at least on one housing side. This has the advantage that at least one part of the mechanical coupling means of the first housing part and at least one part of the mechanical coupling means of the second housing part interact directly with one another and accordingly can bring about a high mechanical stability of the connecting terminal. Another advantage is that an improved sealing effect on the interior of the connecting terminal with respect to the environment can be achieved by means of such overlapping housing regions.

According to an advantageous development of the invention, such overlapping housing regions of the housing parts are arranged at least on the housing side situated closest to a conductor bar of the connecting terminal. This has the advantage that it is possible without additional outlay to achieve the abovementioned sealing effect, in particular, at a point at which the essential current-carrying component, namely the conductor bar, is arranged. In this way, clearances and creepage paths of the connecting terminal which are compliant with standards can be provided with little outlay.

According to an advantageous development of the invention, the overlapping housing regions have coupling means designed as latching features.

According to an advantageous development of the invention, overlapping housing regions have a length of at least 30% of the length of a conductor bar of the connecting terminal. Here, the length dimensions are measured in a direction along the conductor insertion direction, i.e. along the longitudinal axis of the conductor bar.

According to an advantageous development of the invention, a spring-force clamping connection of the connecting terminal is formed by at least one clamping spring in combination with a conductor clamping region of a conductor bar of the connecting terminal. This has the advantage that the spring-force clamping connection can be achieved in a simple manner with a small number of components. A mechanically robust and reliable spring-force clamping connection is thereby formed.

According to an advantageous development of the invention, the clamping spring has at least one clamping leg and at least one bearing leg. A spring-force clamping connection of the connecting terminal is then formed by a clamping leg of the clamping spring in combination with the conductor clamping region of the conductor bar. The bearing leg is used to support the clamping spring.

According to an advantageous development of the invention, the conductor bar of the connecting terminal has at least one punched-out, angled material region, on which the bearing leg of a clamping spring is supported. In particular, the material region punched out of the conductor bar can be designed with a window-like opening. This has the advantage that the spring-force clamping connection can advantageously be supplied as a preassembled unit inasmuch as a clamping spring of the connecting terminal is hooked by means of its bearing leg into the window-like opening, in particular onto a transverse web formed there, and the clamping leg is hooked onto the conductor clamping region of a conductor bar.

According to an advantageous development of the invention, a lever-actuated opening mechanism for opening the clamping point of the respective spring-force clamping connection is arranged on the first housing part and/or on the second housing part, wherein the opening mechanism has a pivotable actuating lever. By means of an actuating lever of this kind, high convenience of operation of the connecting terminal is achieved. A user can open and close the clamping point at any time without an additional tool.

According to an advantageous development of the invention, the actuating lever is arranged on a different housing side of the housing of the connecting terminal from a housing side which has overlapping housing regions. In particular, the actuating lever or actuating levers can be arranged on a housing side which is opposite to a housing side having overlapping housing regions. In this way, the actuating lever or levers can be arranged in a space-saving manner on the housing of the connecting terminal, resulting in a compact connecting terminal of small dimensions, despite the additionally present actuating levers.

According to an advantageous development of the invention, the actuating lever has two mutually spaced side wall sections, which enter at least partially, by means of a pivot bearing region, into the first and the second housing part respectively and are connected to one another by a transverse web to form a lever arm at a distance from the pivot bearing region. Here, the pivot bearing regions of the mutually spaced side wall sections of an actuating element form an axis of rotation about which the actuating element is pivotably mounted in the respective housing part. An associated spring-force clamping connection is then accommodated at least partially in the space between the pivot bearing regions of an actuating element.

The actuating element thus forms an actuating lever which is of approximately U-shaped design in cross section and accommodates the spring-force clamping connection at least partially in the free space delimited laterally by the side wall sections. Thus, the pivot bearing regions are not situated above, below, in front of or behind the spring-force clamping connection but laterally next to the spring-force clamping connection or the clamping spring, to be actuated, of the spring-force clamping connection.

In this way, a very compact connecting terminal is achieved, in which the actuating lever with the pivot bearing regions arranged laterally next to the spring-force clamping connection in the housing part is mounted pivotably in a stable position and robustly in the housing part.

The pivot bearing regions have actuating sections which are each designed to act upon an associated clamping spring of a spring-force clamping connection when the actuating element is pivoted from a closed position, in which the actuating element is pivoted by means of its transverse web in the direction of the housing part, and a clamping point, formed by the spring-force clamping connection, for clamping an electrical conductor is closed, into an open position, in which the actuating element is pivoted by means of its transverse web away from the housing part, and a clamping point, formed by the spring-force clamping connection, for clamping an electrical conductor is open.

Two actuating sections are arranged on the pivot bearing regions of the side wall sections at a shorter distance apart than the distance between the side wall sections. In this arrangement, the actuating sections extend parallel to the side wall sections and are formed integrally with the side wall sections in such a way that there is in each case one guide slot between an actuating section and the associated, directly adjacent side wall section. One guide web of the housing part in each case then enters an associated guide slot for guiding the actuating element during a pivoting movement about a pivoting axis in the pivot bearing region.

With the aid of the actuating sections, which are spaced apart from the side walls of the U-shaped lever arm by an intervening guide slot, it is ensured that the lever arm can be supported pivotably in a manner secure against tilting by a housing-part guide web which enters a respective guide slot. With the aid of the guide slots and the guide webs engaging thereon, it is possible in a space-saving manner to achieve very stable pivot bearing assemblies, which are situated substantially laterally next to the spring-force clamping connections.

By means of the interplay of the measures described, an extremely compact connecting terminal is obtained, the pivoted levers of which are pivotably mounted in a stable manner in the housing part without actuating forces acting on the at least one pivoted lever imposing excessive loads on the housing part.

According to an advantageous development of the invention, the actuating element is matched to the housing part and the associated spring-force clamping connection in such a way that the lever pivoting force acting on the transverse web in order to pivot the actuating element from the closed position into the open position and the spring actuating force exerted by the actuating sections on the clamping spring during pivoting of the actuating element from the closed position into the open position act on the same side relative to the axis of rotation.

By means of the positioning of the axis of rotation in the housing part through appropriate embodiment of the pivot bearing regions and through suitable arrangement of the actuating sections relative to the clamping spring, it is ensured that the lever pivoting force in relation to the pivoting axis applied externally to the actuating lever acts on the same side of the axis of rotation as the spring actuating force applied to the clamping spring by the actuating sections. This provides kinematics which allow a very compact construction of a conductor connection terminal while ensuring optimum force transmission. In particular, it is possible to ensure that the lever pivoting force and the spring actuating force act in the same direction, i.e. upward or downward. Here, "upward" is taken to mean a basic direction irrespective of the precise angle of extent, corresponding to the direction of extent of an open lever arm toward the free end. "Downward" is taken to mean the opposite direction irrespective of the precise angular position. It is therefore not crucial that the forces act as it were parallel to one another.

A particularly compact construction with optimum guidance and support for the actuating elements can be achieved if the adjacent side wall sections of two actuating elements arranged next to one another in the housing part directly adjoin one another. Here, the outer walls of the side wall sections of adjacent actuating elements provide mutual guidance and give additional support to the adjacent actuating element.

According to an advantageous development of the invention, the actuating sections have an outer circumference in the form of a circular segment with a V-shaped notch to form a shoulder projecting in the direction of the center of the actuating section. In each case, the at least one spring-force clamping connection has a conductor bar section and a clamping spring having an actuating tab. During the pivoting of the actuating element to open a clamping point formed between a clamping edge of the clamping spring and the conductor bar section for clamping an electrical conductor, the actuating tab of the clamping spring rests on the shoulder.

With the aid of such a shoulder, which is adjoined by a free space situated thereabove, a stable support for an actuating tab of the clamping spring is created, ensuring that the spring actuating force is transmitted in an optimum manner to the clamping tab of the clamping spring via the shoulder. By means of the shoulder projecting in the direction of the center of the actuating section, a free space situated thereabove is provided, with the result that the clamping spring can otherwise rise freely from the shoulder, even without lever actuation, in order to exert a spring clamping force on the electrical conductor without being affected by the lever arm.

According to an advantageous development of the invention, the side wall sections of an actuating element are connected to one another by a transverse web designed in such a way that the transverse web extends from the free end of the side wall sections to the housing part in the state of the actuating element in which said element is pivoted up, in which the clamping point is open. In this way, optimum stability of the lever arm, especially in respect of torsional strength and security against bending, is achieved while exploiting the available installation space.

According to an advantageous development of the invention, the transverse web projects beyond the free end of the side wall sections, that opposite the pivot bearing region. This provides a shoulder for gripping the transverse web and exerting a lever pivoting force. The projecting end of the transverse web enables the lever arm to be better gripped by hand or a screwdriver to be better inserted underneath for the purpose of opening.

Very stable and tolerance-minimized support for the actuating elements in the housing part can be achieved if the pivot bearing regions are supported on a section of a conductor bar of the associated spring-force clamping connection. Here, the solid conductor bar, which is generally very stable, forms a support for the actuating element, and therefore the conductor bar with the associated clamping spring and the actuating element are substantially self-supporting in respect of the effect of forces and moments, and there are no relatively large forces and moments acting on the housing part when the spring-force clamping connection is actuated by pivoting the actuating element.

It is furthermore advantageous if the outer contours of the actuating sections are situated in the space between the plane defined by a conductor bar of the associated spring-force clamping connection and a plane defined by a bearing leg of the associated spring-force clamping connection. This allows a very compact construction combined with optimum action of the force of the actuating element on the spring-force clamping connection.

According to an advantageous development of the invention, it is proposed that the actuating element has two mutually spaced lever arm sections, which enter at least partially by means of a pivot bearing region into the housing part and are connected to one another by a transverse web to form a lever arm at a distance from the pivot bearing region, that, on the side of the housing part on which the at least one actuating element is arranged, the at least one spring-force clamping connection is covered by an outer boundary wall of the housing part, and side wall sections adjoining a respectively associated spring-force clamping connection on both sides of the outer boundary wall extend into the interior of the housing part, and that, in the closed state of the respective actuating element, in which they have been pivoted down in the direction of the housing part, the lever arm sections of the actuating element adjoin a respectively associated side wall section situated laterally next to a spring-force clamping connection.

According to an advantageous embodiment of the invention, a respective section of an outer boundary wall of the housing part is arranged directly underneath the transverse web of the respectively associated actuating element in the closed state of the associated actuating element, in a free space which is formed by the transverse web and lever arm sections adjoining said web. In the closed state of the pivoted lever, the free space formed in the volume of the pivoted lever by the transverse web and the lever arm sections adjoining said web is thus at least partially filled by a housing wall section of U-shaped cross section, with its upper boundary wall of the housing part and the side wall sections projecting into the interior of the housing part. This free space is thus used to accommodate a housing wall section of U-shaped cross section and hence to improve the clearances and creepage paths while achieving a compact construction.

According to an advantageous development of the invention, there is an interspace between the outer boundary wall of the housing part, which is situated directly underneath the transverse web of the respective actuating element in the closed state of the associated actuating element, and an adjacent conductor insertion opening boundary wall for a conductor insertion opening. The space between the conductor insertion opening and the transverse web is then not completely filled with the insulating material when the actuating element is in the closed state, i.e. when the pivoted lever has been pivoted down. On the contrary, there is a clearance between the boundary wall for the conductor insertion opening and the outer boundary wall of the housing part, the wall directly adjoining the transverse web. In an advantageous embodiment, an interspace of this kind can also be used as a test opening.

The object stated at the outset is furthermore achieved by a method for assembling a connecting terminal for connecting at least two electrical conductors to one another, having the following steps:

a) hooking clamping springs of the connecting terminal into a conductor bar of the connecting terminal, b) placing a connecting part on the conductor bar, c) placing the actuating lever over the clamping springs as far as the conductor bar and moving it into a predetermined open position, d) pushing a first and a second housing component onto the preassembled unit comprising the clamping springs, the conductor bar and the connecting part, e) connecting the first and the second housing parts mechanically to one another and/or to the connecting part.

In this way, the connecting terminal can be assembled quickly and with little effort, in particular substantially without tools. Automated assembly, e.g. by means of robots, is also assisted thereby.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
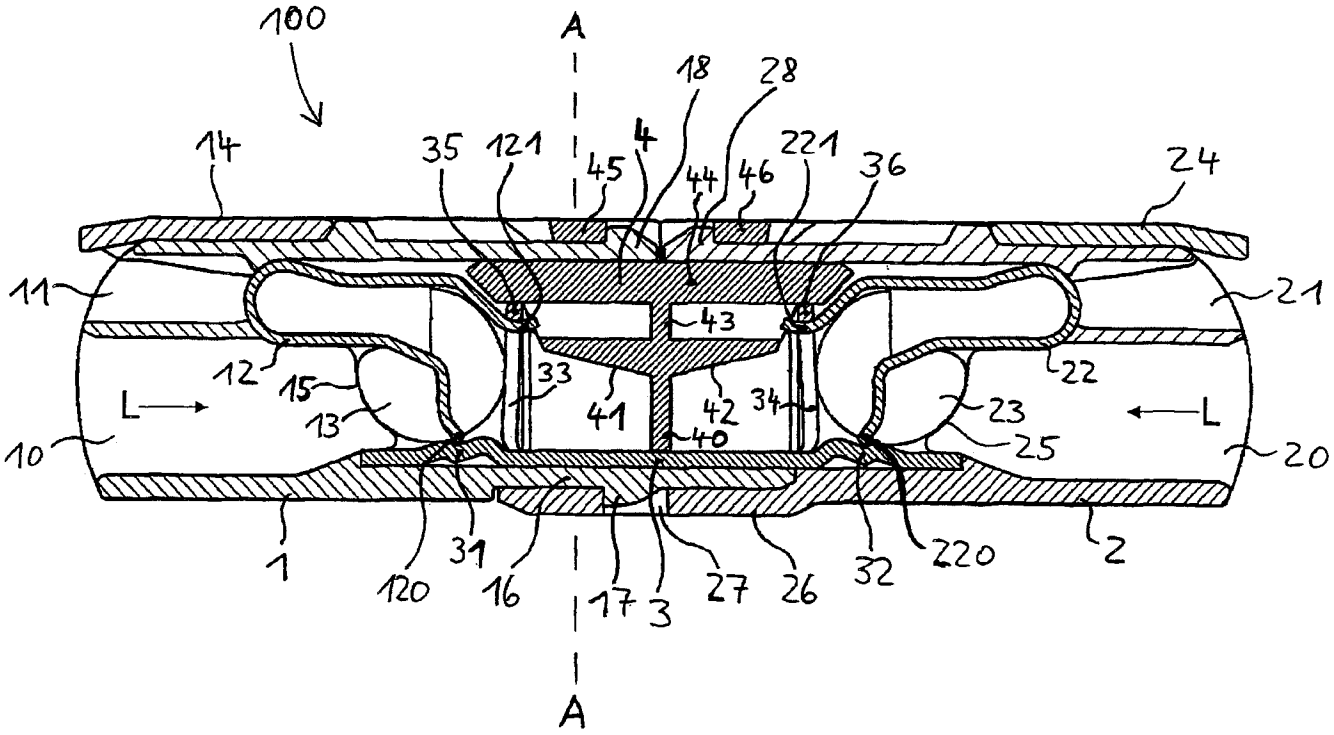
FIG. 1 shows a connecting terminal in a lateral sectioned view.

The connecting terminal shown in FIG. 1 has a first housing part 1 and a second housing part 2. The housing parts 1, 2 have a parting plane arranged vertically in FIG. 1 and are disposed in a "back-to-back" arrangement. Only in the lower region do the housing parts 1, 2 overlap by means of respective housing regions 16, 26. Otherwise, the housing parts 1, 2 are of substantially identical mirror-symmetrical construction internally. Each of the housing parts 1, 2 has a conductor insertion opening 10, 20, a test opening 11, 21, a clamping spring 12, 22 arranged in the housing part 1, 2, and a lever-actuated opening mechanism having an actuating lever 13, 14 and 23, 24, respectively, which is provided for opening a clamping point of respective spring-force clamping connections.

A conductor bar 3, which is manufactured from electrically conductive metallic material, is furthermore arranged in the interior of the housing parts 1, 2. As can be seen in FIG. 1, the conductor bar 3 is designed as a continuous integral conductor bar which extends from the first housing part 1 to the second housing part 2. Together with a clamping-leg end 120 of the clamping spring 12, a conductor clamping region 31, arranged in the first housing part 1, of the conductor bar 3 forms a first spring-force clamping connection. In corresponding fashion, a conductor clamping region 32, arranged in the second housing part 2, of the conductor bar 3 forms a second spring-force clamping connection with a clamping-leg end 220 of the clamping spring 22.

Figure 8:
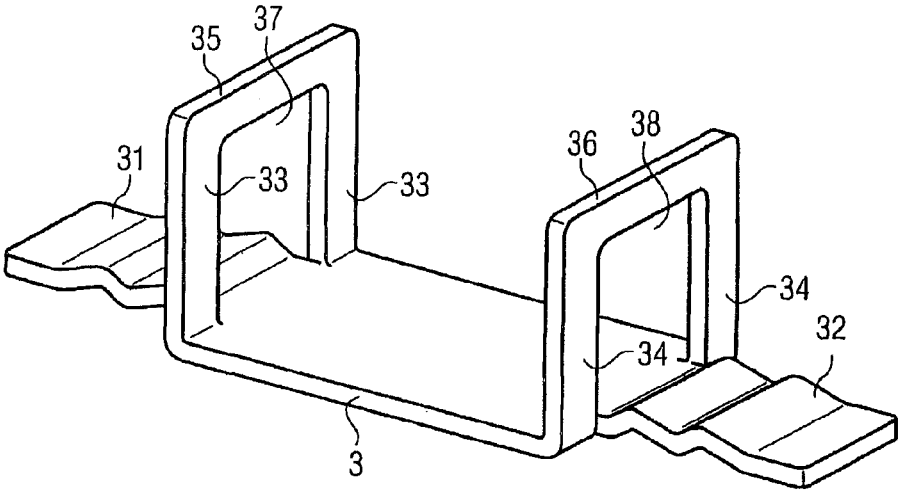
FIG. 8 shows a conductor bar in perspective.

The conductor bar 3 has punched-out material regions 33, 34, 35, 36, which are bent upward out of the plane of the conductor clamping regions 31, 32 and each form a window-like opening 37, 38, as shown in FIG. 8. A respective bearing-leg end 121, 221 of the respective clamping spring 12, 22 is inserted into a respective window-like opening 37, 38 and is supported on a horizontally extending transverse web 35, 36 of the upward-bent material regions of the conductor bar 3. In order to fix the respective clamping spring 12, 22 in a somewhat prestressed state in the position visible in FIG. 1, in which no electrical conductor has been inserted into the respective conductor insertion opening 10, 20, wave-like deformations are formed in the respective conductor clamping regions 31, 32 of the conductor bar 3.

A conductor to be inserted into the respective conductor insertion opening 10, 20 is inserted in a conductor insertion direction L, as illustrated in FIG. 1. A test pin can be inserted into the respective test opening 11, 21 in order to measure the voltage across the respective clamping spring 12, 22 by means of a meter, for example.

On the one hand, the housing parts 1, 2 are coupled mechanically to one another by their overlapping housing regions 16, 26. For this purpose, the first housing part 1, for example, has a latching nose 17, and the second housing part 2 has an aperture 27 in housing region 26. The latching nose 17 can then latch in behind a latching edge, which is formed on a rim of the aperture 27, thereby fixing the housing parts 1, 2 on one another.

For additional mechanical coupling of the housing parts 1, 2 to one another and for additional mechanical stabilization of the overall structure of the connecting terminal 100, the terminal has, as a further component, a connecting part 4, which is situated in the interior of the housing parts 1, 2, in the region of transition from one housing part 1 to the other housing part 2. The connecting part 4 has a support region 44, which is arranged on the inside of the upper housing side of the housing parts 1, 2 and, for example, rests against said side. This support region 44 ensures mechanical support for the housing parts 1, 2 with respect to transverse forces, i.e. forces transverse to the conductor insertion direction L. For the mechanical coupling of the housing parts 1, 2 to one another in the upper region of the housing parts 1, 2 there are furthermore respective latching noses 18, 28, which are latched in behind latching edges formed by upper transverse webs 45, 46 on the connecting part 4.

The connecting part 4 has additional functionalities. From the support region 44, the connecting part 4 extends via an interspace 43 to a material region formed in a T shape relative thereto, which, on its underside, i.e. in a region in which the electrical conductors to be inserted are to be arranged, has sloping regions designed as conductor-guiding sections 41, 42. Electrical conductors inserted into the respective conductor insertion opening 10, 20 are thereby guided to a defined position within the connecting terminal. In order to limit the depth of insertion of the electrical conductors, there is a conductor stop 40, which can likewise be formed on the connecting part 4, e.g. in the form of the substantially vertical wall that can be seen in FIG. 1.

Together with corresponding inner cavities of the housing parts 1, 2, the connecting part 4 thereby forms corresponding conductor-receiving spaces for receiving in each case at least one electrical conductor, which are situated opposite one another. In this arrangement, the opposite conductor insertion openings 10, 20 are situated in a common plane. The conductor bar 3 is thus a common conductor bar for the first and the second spring-force clamping connection.

To enable the clamping point of the respective spring-force clamping connection to be opened in a simple and ergonomic manner, in particular without an additional tool, there are the abovementioned opening mechanisms having the actuating levers 13, 14 and 23, 24, respectively. For this purpose, each actuating lever has a lever arm 14, 24, which is coupled to an actuating disk 13 and 23, respectively. When the respective actuating lever is pivoted owing to a movement of the lever arm 14, 24, the actuating disk 13, 23 performs a corresponding rotary motion about a central axis, which is simultaneously an axis of rotation. During this process, the respective clamping spring 12, 22 is deflected upward at its clamping-leg end 120, 220, i.e. in the direction of the bearing-leg end 121, 221. The clamping point is thereby released, thus allowing an electrical conductor that is already being clamped to be removed easily or a conductor which is to be inserted to be inserted without exertion. The respective actuating disk 13, 23 is supported at the bottom and at the rear on a bearing contour 15, 25, which is present within the respective housing part 1, 2, e.g. is formed integrally with the respective housing part 1, 2.

Figure 2:
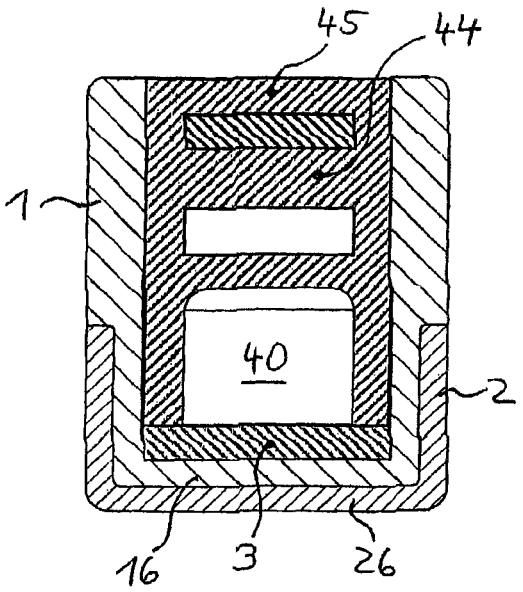
FIG. 2 shows the connecting terminal according to FIG. 1 along section plane A-A in FIG. 1.

FIG. 2 additionally shows the construction of the connecting terminal according to FIG. 1 in a cross section along section plane A-A, as depicted in FIG. 1.

Figure 3:
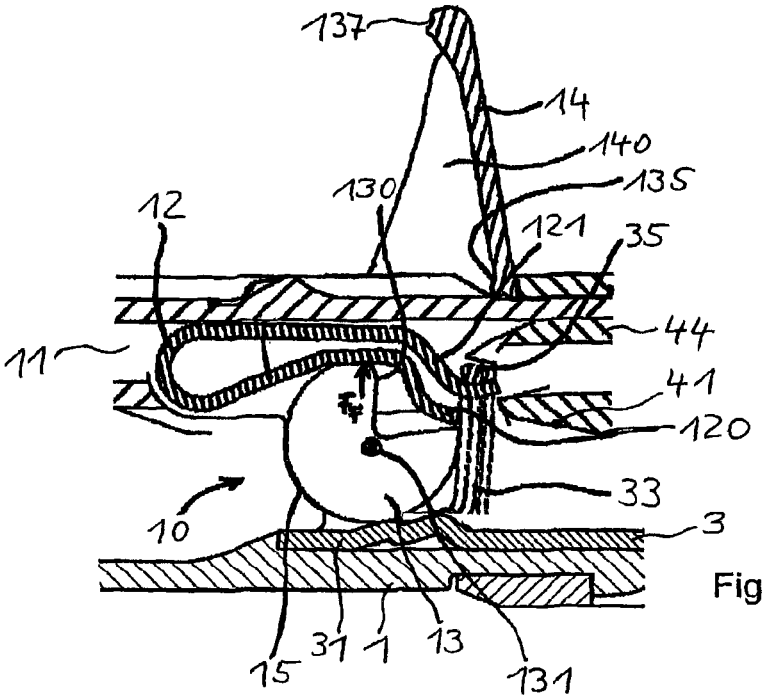
FIG. 3 shows a detail of the housing part illustrated on the left in FIG. 1 in section with the actuating lever open.

FIG. 3 shows the mode of operation of the respective opening mechanism for opening the clamping point of a respective clamping contact with reference to the spring-force clamping connection illustrated on the left in FIG. 1, i.e. shows a detail of the components arranged in the first housing part 1. The mode of operation and construction in the second housing part 2 are identical (and mirror-symmetrical).

FIG. 3 shows the opening mechanism with the lever arm 14 pivoted upward, with the result that the clamping point of the spring-force clamping connection is open. It can be seen that the clamping-leg end 120 of the clamping spring 12 is now spaced apart from the conductor clamping region 31 of the conductor bar 3. This has been accomplished by rotation of the actuating disk 13, the actuating region 130 of which presses against the clamping leg of the clamping spring 12 and deflects it upward.

It can furthermore be seen in FIG. 3 that the actuating lever 13, 14 can have a side wall 140, by means of which the mechanical connection between the lever arm 14 and the actuating disk 13 is established and which contributes to additional mechanical stabilization of the opening mechanism.

When viewed together with FIG. 8, it becomes clear that the actuating disks 13 in the form of circular segments are situated next to the conductor bar tabs 31 extending in the conductor insertion direction L and are therefore accommodated completely (at the bottom and front) in the bearing recesses 15 of the housing part 1. At the rear, the actuating disks 13 are supported against the frame 33 of the conductor bar 3.

Figure 4:
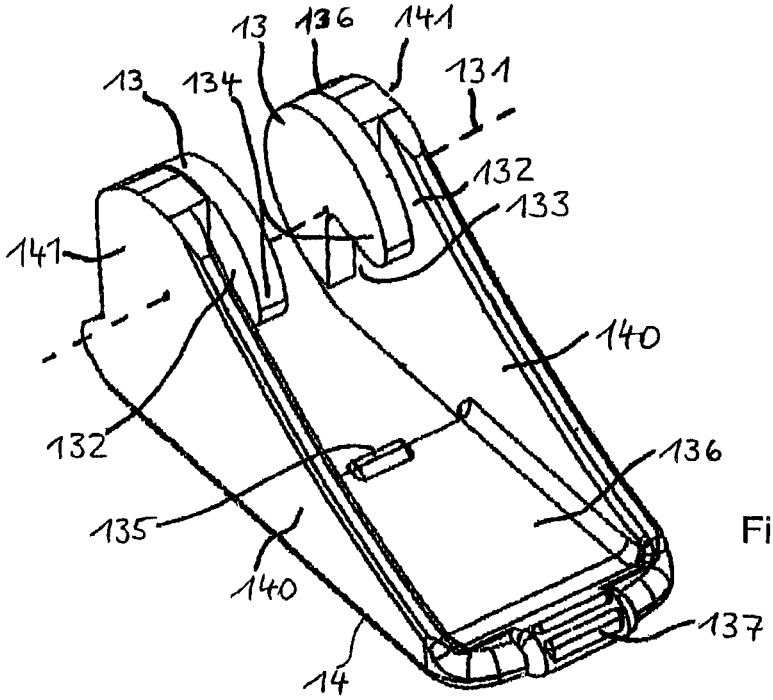
FIG. 4 shows the actuating lever in perspective.

FIG. 4 shows a perspective view of an actuating lever 13, 14 from the underside. This shows the configuration of two mutually spaced side wall sections 140, which is basically U-shaped in section, said sections being connected to one another at their free end at a lateral edge by means of a transverse web 136. It will be apparent that the side wall sections 140 taper toward the free end from the end regions 141 adjacent to the pivot bearing. It can be seen that there is an actuating bead 137 at the free end of the transverse web 136. It will also be apparent that the actuating bead 137 of the transverse web 136 projects forward beyond the free ends of the side wall sections 140, wherein the inside of the transverse web 136 slopes at the free end edge. This counteracts slippage when a lever actuating force of the lever arm 14 is applied.

It can furthermore be seen that the actuating disks 13 have outer end faces 136 which are curved in the form of circular segments and by means of which the actuating lever 13, 14 is supported in the housing part 1 so as to be pivotable about a virtual axis of rotation 131.

The axis of rotation 131 extends through the center of a circular segment formed by the outer end face 136.

It can furthermore be seen that actuating disks 13 in the form of circular segments and having a V-shaped notch 133 are provided, said disks being spaced apart from the side wall sections 140 by a guide slot 132. Formed in the region of each of the V-shaped notches 133 is an actuating section 134, which serves to impose a spring actuating force on an associated clamping leg of a clamping spring 12, 22. It can be seen that the actuating sections 134 as well as the transverse web 136, on which a lever pivoting force is exerted, are situated on the same side relative to the axis of rotation 131. This has the effect that the spring actuating forces $F_F$ exerted by the actuating sections 134 act on the same side, relative to the axis of rotation 131, as the lever pivoting force applied to the transverse web 136 for pivoting.

It will furthermore be apparent that a latching nose 135 projects from the transverse web 136 approximately in the direction of the actuating disk 14 and of section 31, on the opposite side from the actuating bead 137. The latching nose 135 is used to latch the actuating lever 13, 14 to the housing part 1 in the closed position.

Figure 5:
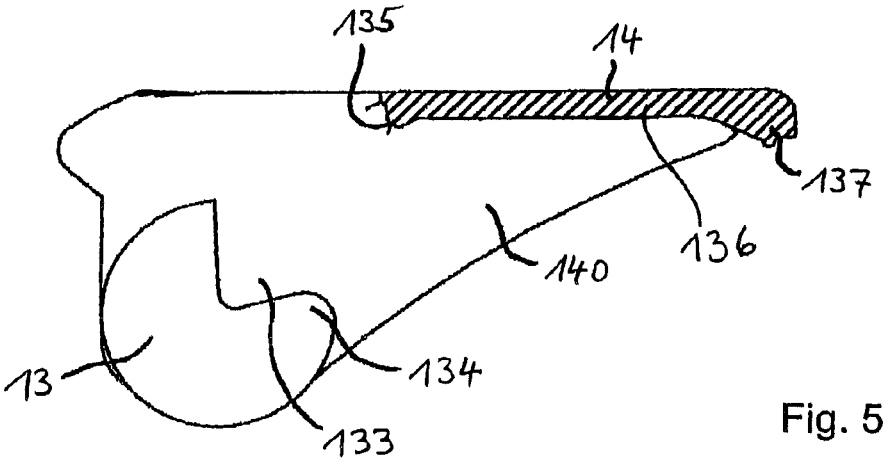
FIG. 5 shows the actuating lever in a lateral sectioned view.

FIG. 5 shows a sectional side view through the actuating element 4 from FIG. 4. Here, it will once again be apparent that the side wall sections 140 are connected by a transverse web 136 connecting them on the upper side of the actuating element 14. Here, the transverse web 136 extends over only part of the length of the side wall sections 140 and, in this case, preferably occupies more than half of the length of the side wall sections 140.

Figure 6:
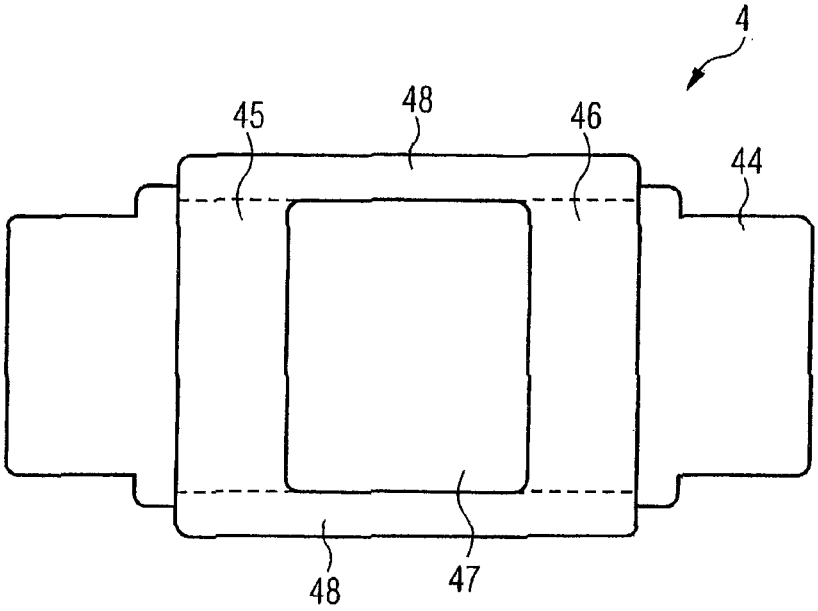
FIG. 6 shows a connecting part of the connecting terminal according to FIG. 1 in plan view.
Figure 7:
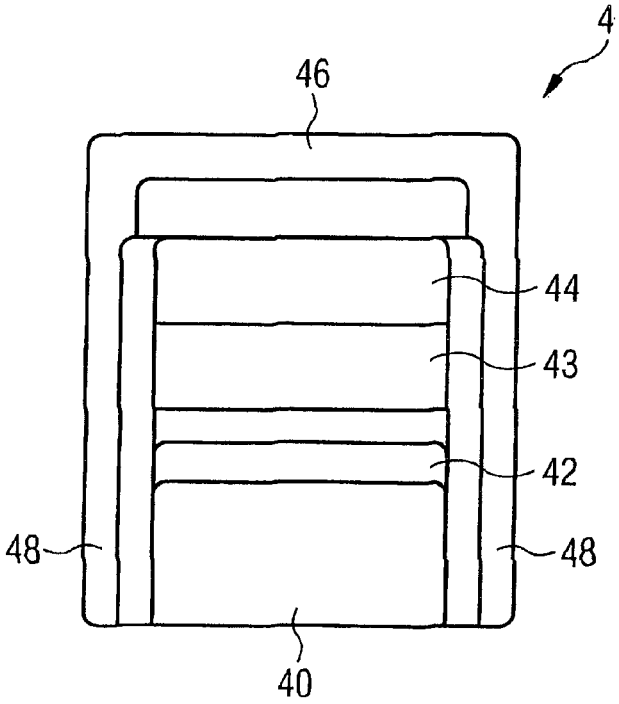
FIG. 7 shows the connecting part according to FIG. 6 in end view in accordance with FIG. 2.

FIGS. 6 and 7 shows the connecting part 4 in isolation in additional views. In particular, it can be seen that, in combination with lateral webs 48, a region 47 of the connecting part 4 open in the manner of a window is formed between the upper transverse webs 45, 46, which form the latching edges for the latching noses 18, 28 of the housing parts 1, 2. The latching noses 18, 28 are then arranged therein in the assembled state of the connecting terminal, as illustrated in FIG. 1.

The connecting terminal 100 can be designed as an individual connecting terminal or as a multiple connecting terminal. In the case of design as a single connecting terminal, a conductor bar 3 according to FIG. 8 is used, for example. In the case of design as a multiple connecting terminal, e.g. a dual connecting terminal, a conductor bar according to FIG. 9 can be used. In this case, a plurality of conductor bars according to FIG. 8 are arranged adjacent to one another and connected to one another by electrically conducting material webs.

Figure 9:
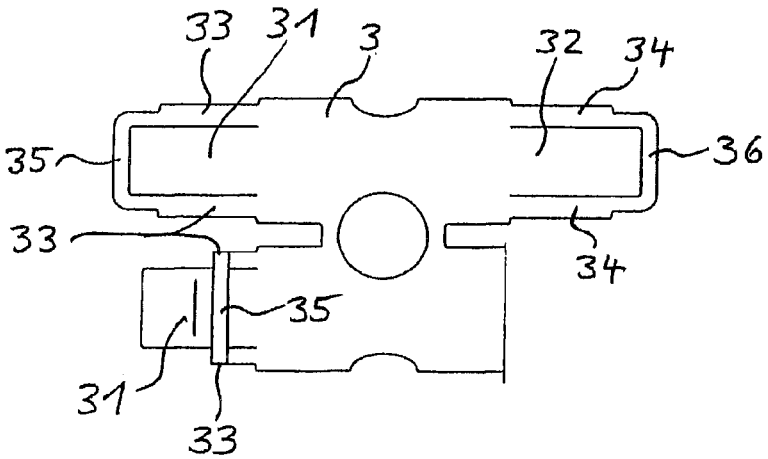
FIG. 9 shows a plan view of a conductor bar with a partially finished and a fully finished region.

From FIG. 9 it can additionally be seen how the conductor bar can advantageously be produced in its final shape from a flat metal part. First of all, a flat metal part is provided with the desired shape by a stamping process, for example. During this process, those material regions 33, 34, 35, 36 which are to be angled upward to form the window-like opening 37, 38 are punched out of the material. They can then be angled upward by a bending process, as illustrated on the left in the lower part of FIG. 9. The undulating contour in the conductor clamping regions 31, 32 can be produced by a bending or embossing step.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connecting terminal for connecting at least a first and a second electrical conductor to one another, the connecting terminal comprising:

at least two separate housing parts, which are connected mechanically to one another and, on opposite housing sides, each have a conductor insertion opening for at least the first or the second electrical conductor which is to be connected, a first spring-force clamping connection for making electrical contact with the first electrical conductor in a first housing part of the at least two separate housing parts, and a second spring-force clamping connection for making electrical contact with the second electrical conductor in the second housing part of the at least two separate housing parts, wherein the first housing part is coupled mechanically to the second housing part via a latching assembly, and wherein the first housing part is additionally coupled mechanically to the second housing part via a connecting part that is formed as a separate component from the first and second housing parts, the connecting part being situated in the interior of the first and second housing parts, in a region of transition from the first housing part to the second housing part.

2. The connecting terminal as claimed in claim 1, wherein the connecting terminal has a conductor bar which extends continuously from the first spring-force clamping connection to the second spring-force clamping connection.

3. The connecting terminal as claimed in claim 2, wherein the connecting part has a partition wall, arranged substantially perpendicular to a conductor insertion direction of the first and/or the second housing part, and arranged between the first spring-force clamping connection and the second spring-force clamping connection.

4. The connecting terminal claimed in claim 3, wherein the connecting part has at least one conductor-guiding section, which is arranged in the conductor insertion direction or obliquely to the conductor insertion direction of the first and/or of the second housing part.

5. The connecting terminal as claimed n claim 1, wherein the latching assembly includes latching hooks and latching recesses, which are designed as mating parts for said hooks.

6. The connecting terminal as claimed in claim 2, wherein the first housing part is designed to overlap the second housing part, at least on one housing side.

7. The connecting terminal as claimed in claim 6, wherein overlapping housing regions of the first and second housing parts are arranged at least on a housing side situated closest to the conductor bar of the connecting terminal.

8. The connecting terminal as claimed in claim 7, wherein the latching assembly at the overlapping housing regions includes latching features.

9. The connecting terminal as claimed in claim 1, wherein each of the first spring-force clamping connection and the second spring-force clamping connection of the connecting terminal are formed by at least one clamping spring in combination with a conductor clamping region of the conductor bar of the connecting terminal.

10. The connecting terminal as claimed in claim 9, wherein the clamping spring of the first and/or of the second spring-force clamping connection is designed as a component separate from the conductor bar.

11. The connecting terminal as claimed in claim 10, wherein the clamping spring of the first and/or of the second spring-force clamping connection is hooked into the conductor bar and fastened in this way.

12. The connecting terminal as claimed in claim 1, wherein a respective lever-actuated opening mechanism for opening a clamping point of the respective spring force clamping connection is arranged on each of the first housing part and the second housing part, wherein the opening mechanism has a pivotable actuating lever.

13. A method for assembling a connecting terminal for connecting at least two electrical conductors to one another, having the following steps:

hooking clamping springs of the connecting terminal into a conductor bar of the connecting terminal;

placing a connecting part on the conductor bar;

placing an actuating lever over the clamping springs and moving the actuating lever into a predetermined open position;

pushing a first and a second housing component onto the preassembled unit comprising the clamping springs, the conductor bar and the connecting part; and connecting the first and the second housing parts mechanically to one another and to the connecting part.

14. The connecting terminal as claimed in claim 1, wherein at an upper end of the connecting terminal, inner surfaces of the first housing part and the second housing part are supported on and directly contact an upper surface of a support region of the connecting part.

15. The connecting terminal as claimed in claim 3, wherein a distal end of the partition wall is supported on and directly contacts an upper surface of the conductor bar.

16. The connecting terminal as claimed in claim 8, wherein one of the overlapping housing regions having the latching hooks and the latching recesses is situated underneath the connecting part.

17. The connecting terminal as claimed in claim 1, wherein a first transverse web and a second transverse web protrude from an upper surface of a support region of the connecting part, the first transverse web having an opening through which a latching hook of the first housing part extends and latches thereto, and the second transverse web having an opening through which a latching hook of the second housing part extends and latches thereto.

* * * * *